US011690770B2

(12) United States Patent
Su et al.

(10) Patent No.: US 11,690,770 B2
(45) Date of Patent: Jul. 4, 2023

(54) MULTIFUNCTIONAL WHEELCHAIR

(71) Applicants: Chien-Chung Su, Taichung (TW); Yu-Min Chang, Taichung (TW)

(72) Inventors: Chien-Chung Su, Taichung (TW); Yu-Min Chang, Taichung (TW)

( * ) Notice: Subject to any disclaimer, the term of this patent is extended or adjusted under 35 U.S.C. 154(b) by 371 days.

(21) Appl. No.: 17/022,894

(22) Filed: Sep. 16, 2020

(65) Prior Publication Data

US 2021/0100702 A1 Apr. 8, 2021

(30) Foreign Application Priority Data

Oct. 7, 2019 (TW) ..... 108136214

(51) Int. Cl.
*A61G 5/10* (2006.01)
*A61G 5/12* (2006.01)
*A61G 5/02* (2006.01)

(52) U.S. Cl.
CPC ..... *A61G 5/1013* (2013.01); *A61G 5/024* (2013.01); *A61G 5/1059* (2013.01); *A61G 5/1091* (2016.11); *A61G 5/121* (2016.11)

(58) Field of Classification Search
CPC .... A61G 5/1013; A61G 5/121; A61G 5/1091; A61G 5/024; A61G 5/1059; A61G 5/1067
See application file for complete search history.

(56) References Cited

U.S. PATENT DOCUMENTS

| | | | | |
|---|---|---|---|---|
| 9,107,507 | B2 * | 8/2015 | Wallis | A61G 5/12 |
| 10,595,684 | B2 * | 3/2020 | McCaffery | A61H 33/00 |
| 2006/0208554 | A1 * | 9/2006 | Nishiwaki | A61G 5/125 297/452.3 |
| 2020/0237602 | A1 * | 7/2020 | Bardgett | A61G 5/14 |
| 2020/0297560 | A1 * | 9/2020 | Montoya | A61G 5/0816 |

* cited by examiner

*Primary Examiner* — Minnah L Seoh
*Assistant Examiner* — Harold Eric Pahlck, III
(74) *Attorney, Agent, or Firm* — Alan D. Kamrath; Karin L. Williams; Mayer & Williams PC

(57) ABSTRACT

A multifunctional wheelchair contains: a body, a support plate, a lifting seat, and a shampoo basin. The body includes a retractable mounting, a chair back, at least one drive device, and two frames. The two frames have two main wheels, the two frames have two guide wheels, and the two armrests are arranged on a second drive device. A respective armrest has an abutting portion, and the retractable mounting have two racks. The support plate is detachably engaged on the retractable mounting of the body. The lifting seat is removably engaged on the retractable mounting of the body, and the lifting seat includes a saddle on a third drive device which is configured to drive the saddle to lift or descend adjustably. The shampoo basin is detachably connected on the chair back and included a washing chamber.

6 Claims, 16 Drawing Sheets

MULTIFUNCTIONAL WHEELCHAIR

BACKGROUND OF THE INVENTION

Field of the Invention

The present invention relates to a multifunctional wheelchair which is adjustable based on using requirements, such as disabilities' lying, piss, defecation, shampoo, or bath.

Description of the Prior Art

A conventional wheelchair is configured to be transportation for the elderly people, physical disabilities or sickness, thus achieving easy mobility. The conventional wheelchair contains a body, a small-diameter guide wheel and a large-diameter push wheel which are fixed on a front end and a rear end of the body. The body has two support racks welded on two sides of the front end of the body and two pedals configured to support user's legs when the user sits on the wheelchair and removes the two legs from a ground, thus moving the wheelchair forward.

However, when disabilities' have lying, piss, defecation, shampoo, or bath, they have to be movable away from the wheelchair troublesomely by their caregivers or families, thus causing danger or falling from the wheelchair.

In addition, toilet aids or a bath chair has to be fixed on a specific space, thus increasing using cost and occupying space.

The present invention has arisen to mitigate and/or obviate the afore-described disadvantages.

SUMMARY OF THE INVENTION

The primary object of the present invention is to provide a multifunctional wheelchair which is adjustable based on using requirements, such as disabilities' lying, piss, defecation, shampoo, or bath, thus obtaining using safety, convenience, and practicality.

Another object of the present invention is to provide a multifunctional wheelchair which is applicable for sitting, laying, piss, defecation, shampoo, and bath based on the requirements, thus reducing using space and using cost.

To provide above-mentioned objects, a multifunctional wheelchair provided by the present invention contains: a body, a support plate, a lifting seat, and a shampoo basin.

The body includes a retractable mounting, a chair back rotatably connected on a rear side of the retractable mounting, at least one drive device fixed between the chair back and the retractable mounting so that the chair back is driven by the first drive device to adjustably rotate to a desired angle, two frames symmetrically mounted on two sides of the retractable mounting, and two armrests arranged on the two frames. The two frames have two main wheels rotatably connected on outer sides of the two frames adjacent to rear ends of the body, and the two frames have two guide wheels rotatably connected on front ends of the frames, the two armrests are arranged on a second drive device so as to be driven by the second drive device to lift or descend adjustably, and a respective armrest has an abutting portion disposed thereon. The retractable mounting have two racks symmetrically fixed on two side of a front end thereof.

The support plate is detachably engaged on the retractable mounting of the body.

The lifting seat is removably engaged on the retractable mounting of the body, and the lifting seat includes a saddle on a third drive device which is configured to drive the saddle to lift or descend adjustably.

The shampoo basin is detachably connected on a top of the chair back of the body, and the shampoo basin includes a washing chamber.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

With reference to FIGS. 1-8 and 15, a multifunctional wheelchair according to a preferred embodiment of the present invention comprises: a body 10, a support plate 20, a lifting seat 30, and a shampoo basin 40.

Figure 1:
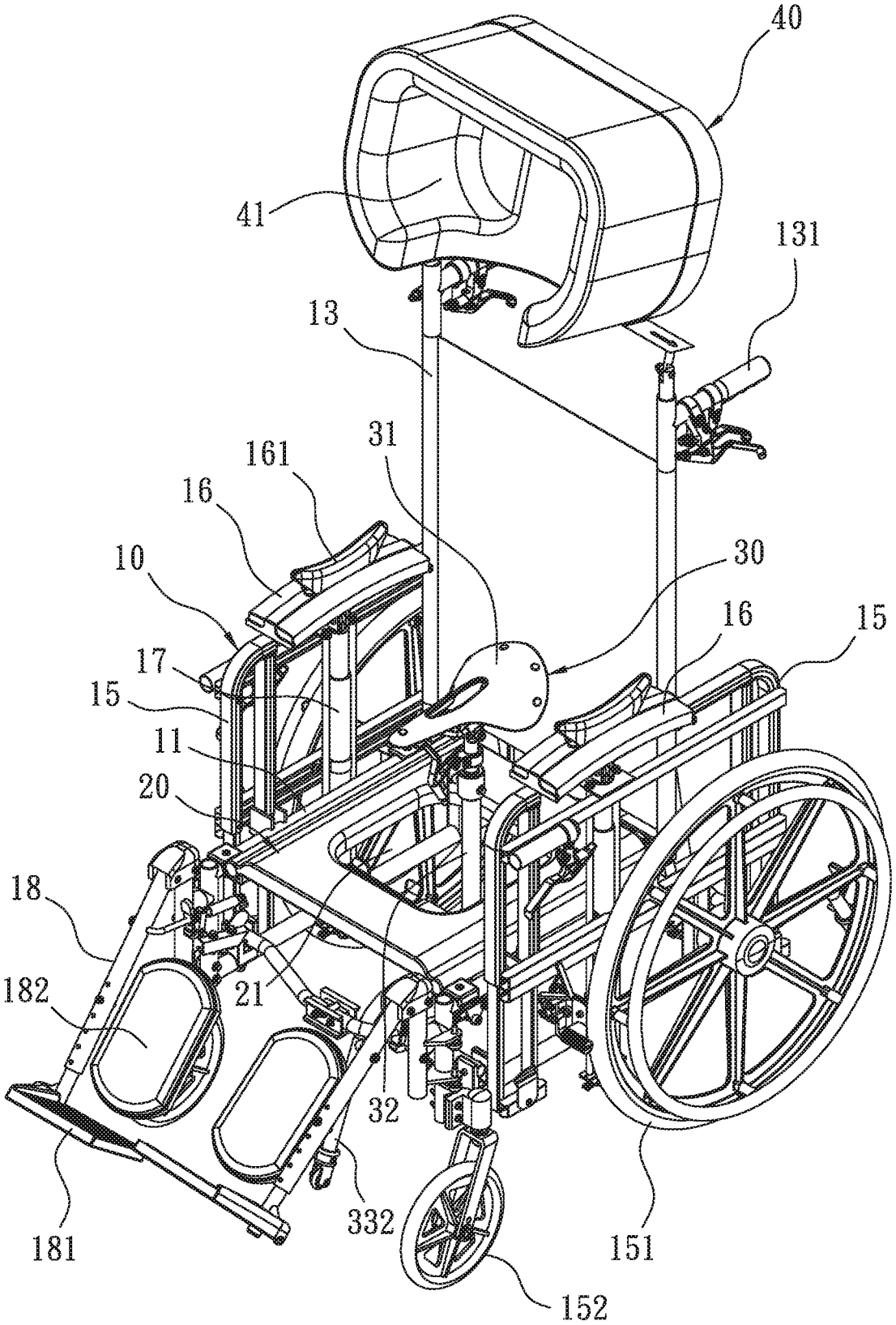
FIG. 1 is a perspective view showing the assembly of a multifunctional wheelchair according to a preferred embodiment of the present invention.
Figure 2:
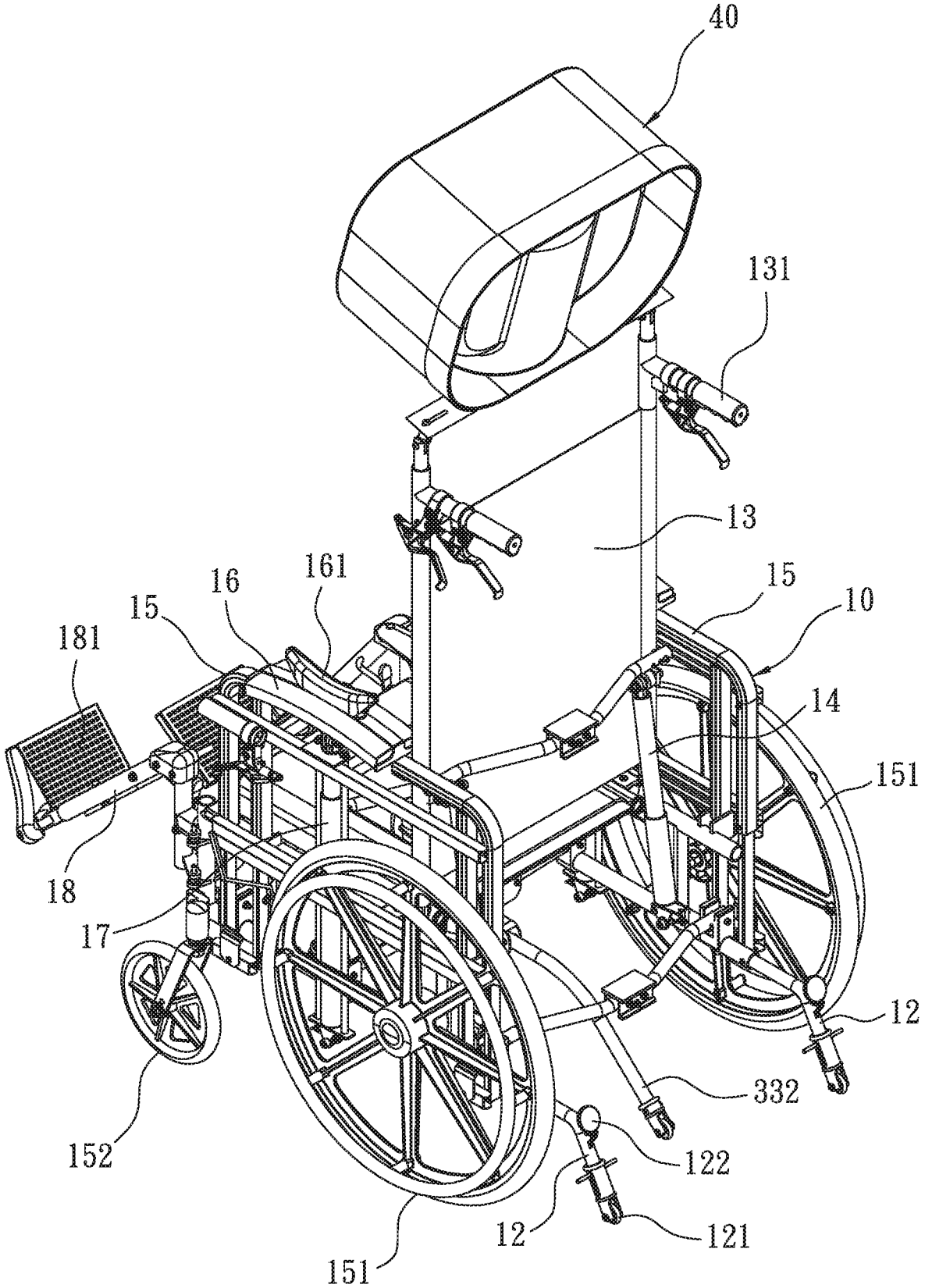
FIG. 2 is another perspective view showing the assembly of the multifunctional wheelchair according to the preferred embodiment of the present invention.
Figure 3:
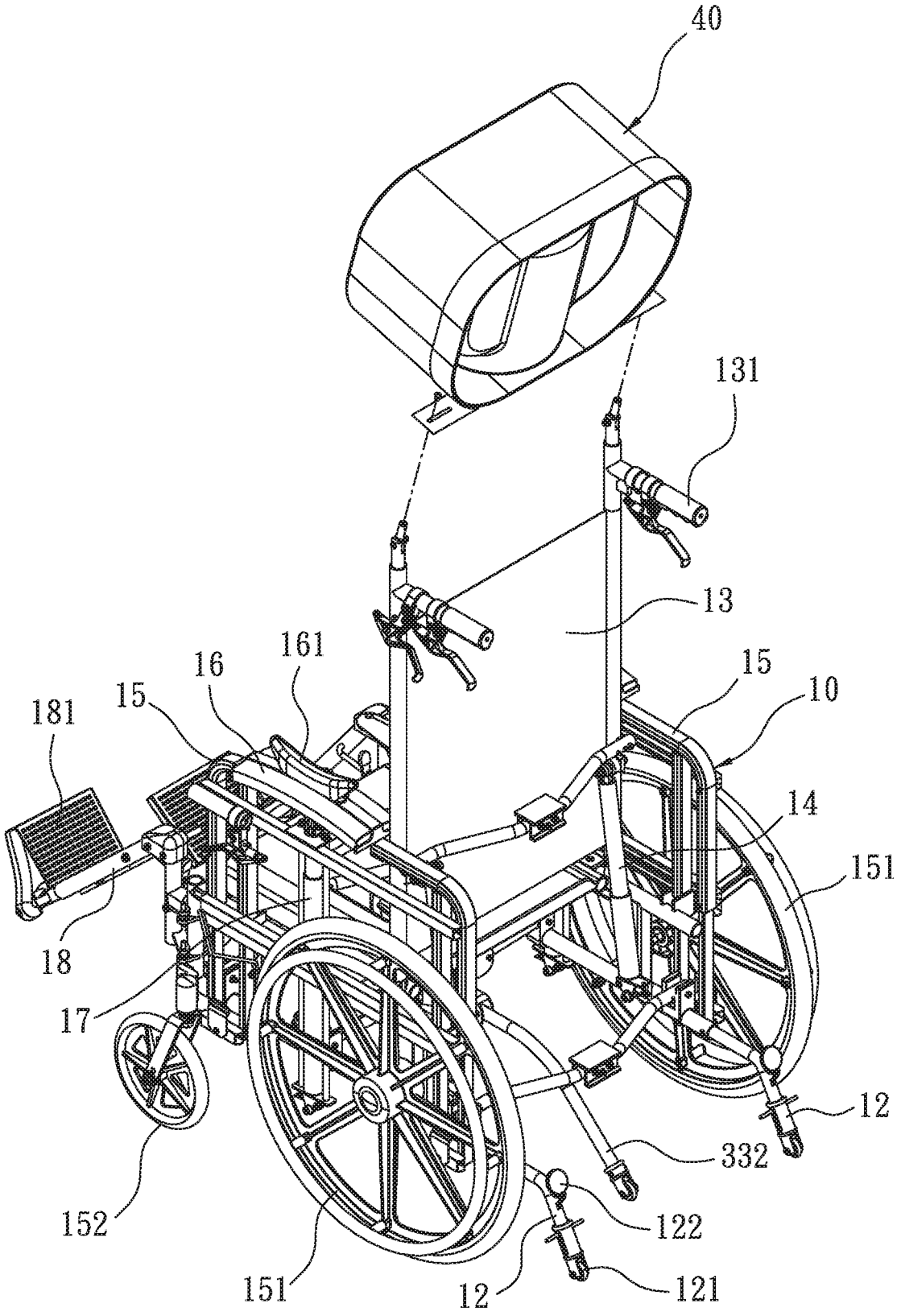
FIG. 3 is a perspective view showing the exploded components of the multifunctional wheelchair according to the preferred embodiment of the present invention.
Figure 4:
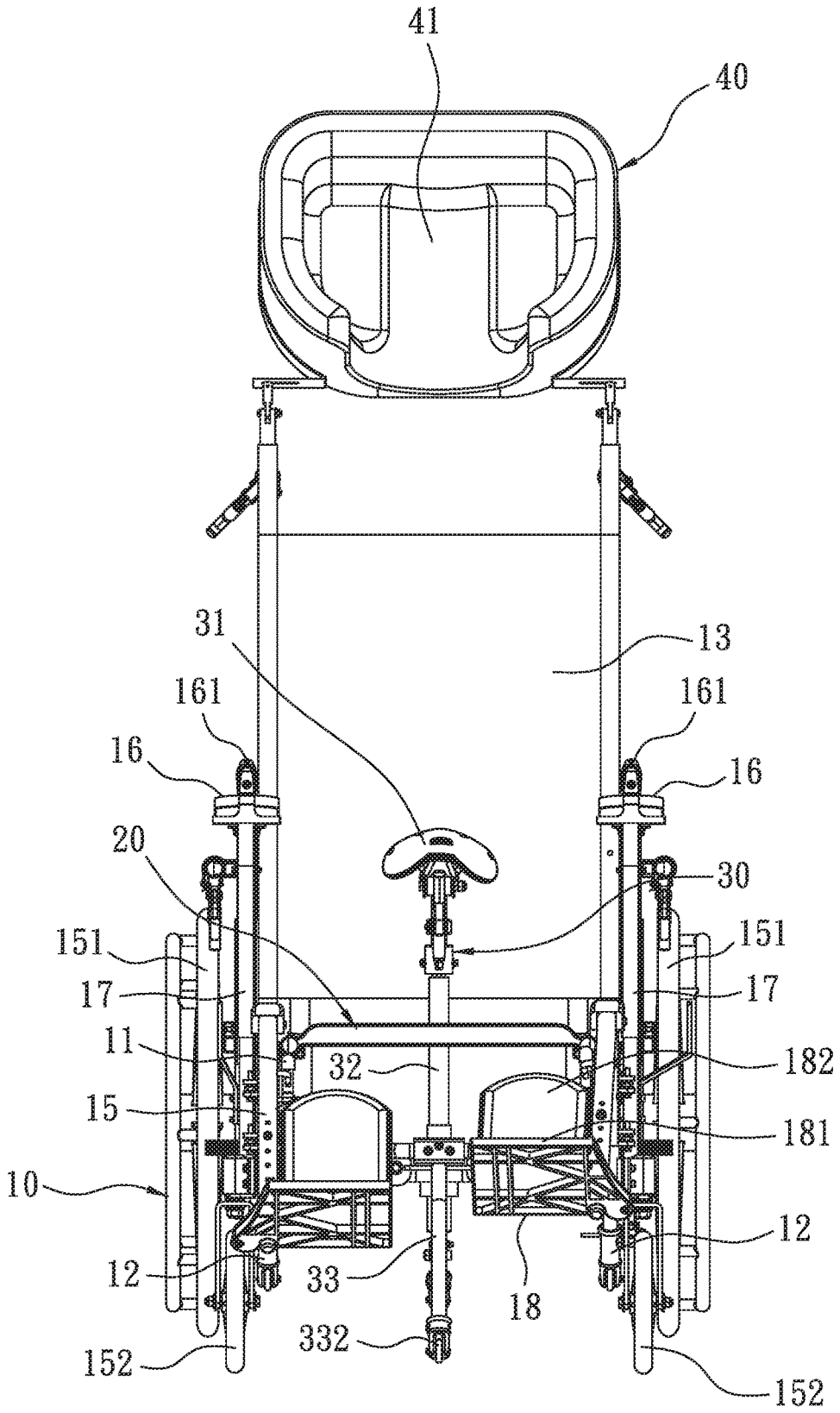
FIG. 4 is a side plan view showing the assembly of the multifunctional wheelchair according to the preferred embodiment of the present invention.
Figure 5:
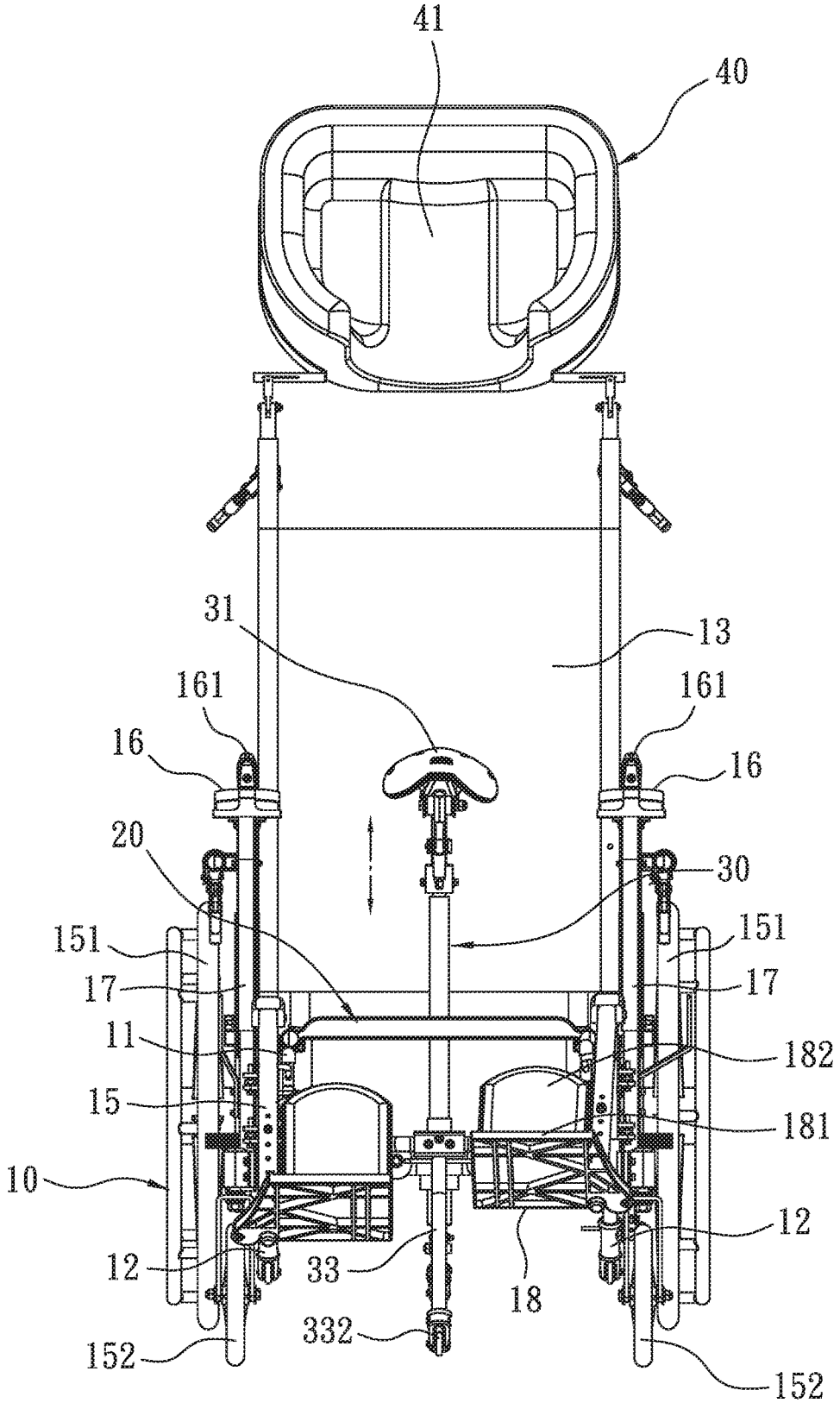
FIG. 5 is a side plan view showing the operation of the multifunctional wheelchair according to the preferred embodiment of the present invention.
Figure 6:
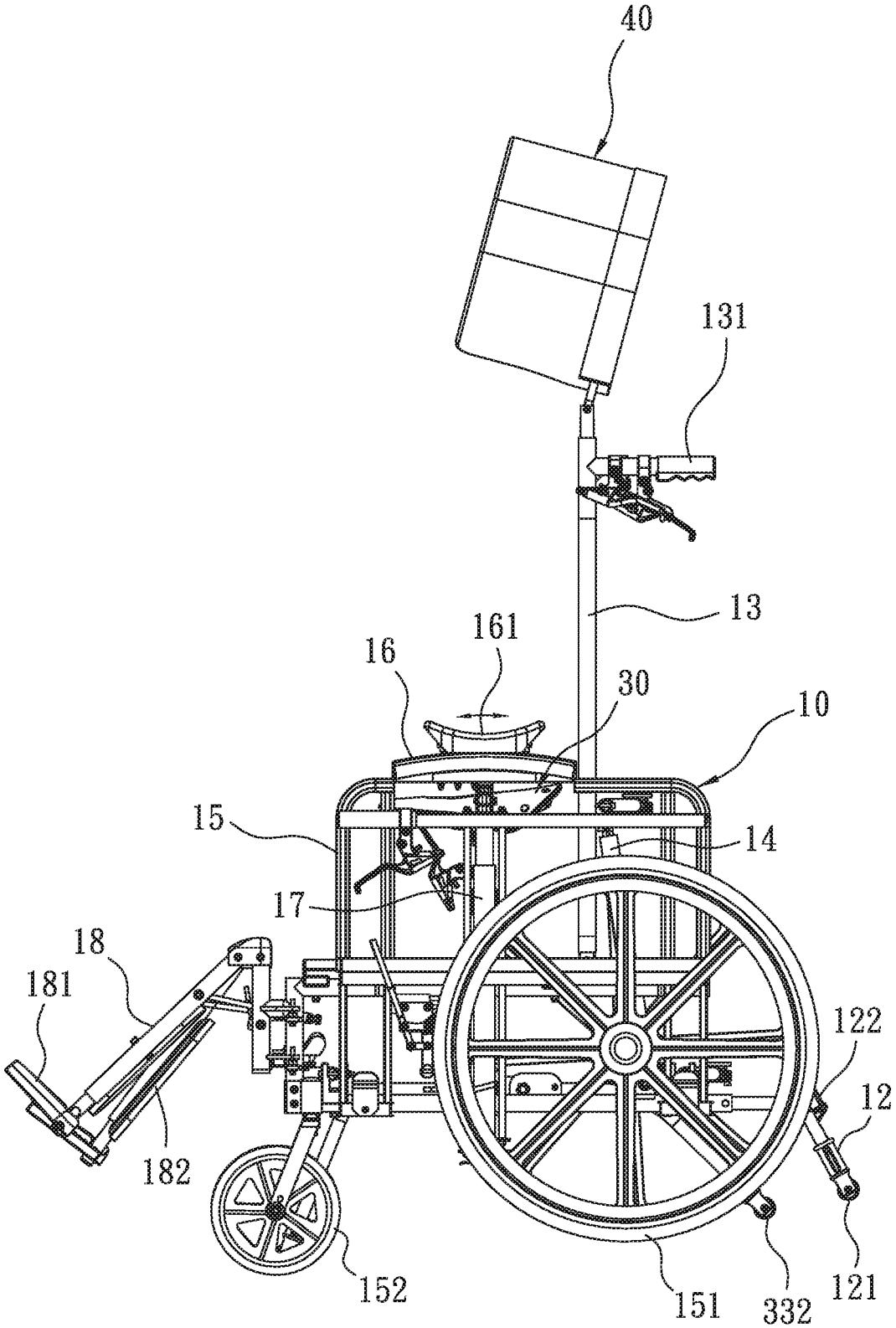
FIG. 6 is another side plan view showing the operation of the multifunctional wheelchair according to the preferred embodiment of the present invention.
Figure 7:
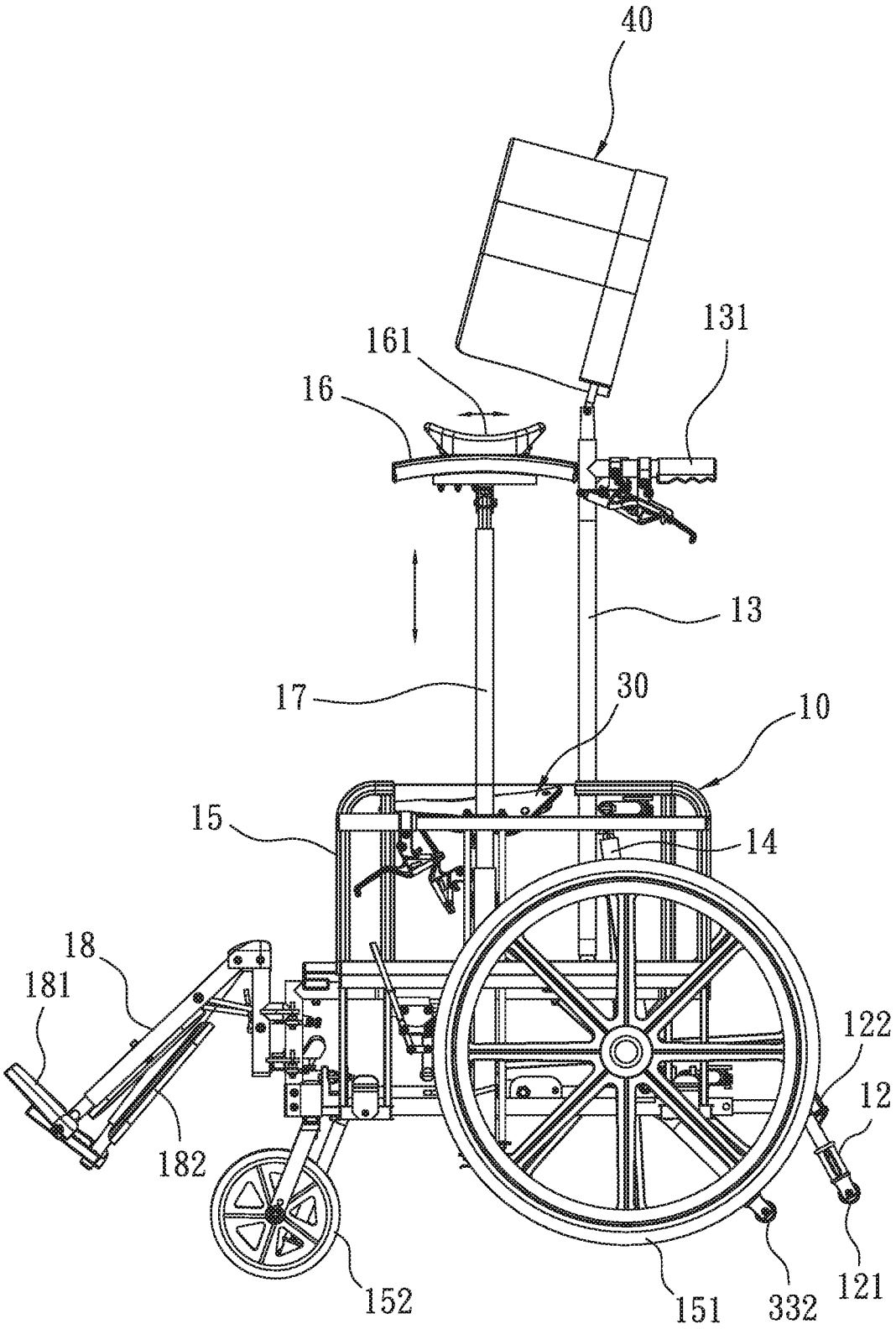
FIG. 7 is also another side plan view showing the operation of the multifunctional wheelchair according to the preferred embodiment of the present invention.
Figure 8:
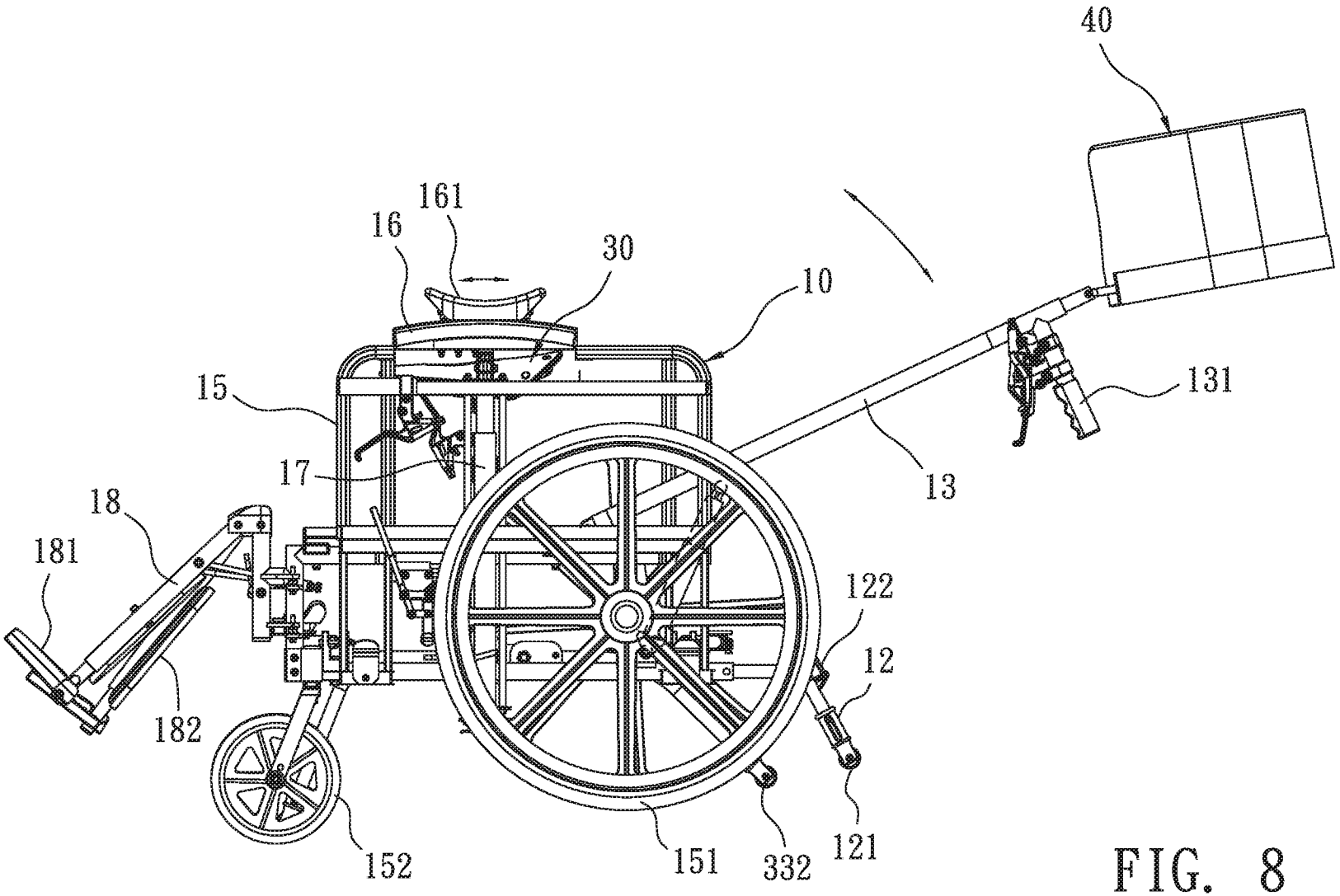
FIG. 8 is still another side plan view showing the operation of the multifunctional wheelchair according to the preferred embodiment of the present invention.

The body 10 includes a retractable mounting 11 (as shown in FIGS. 1, 4 and 5), two wheel sets 12 symmetrically extending downward from a rear side of the retractable mounting 11 (as illustrated in FIGS. 2, 3 and 6-8), wherein a respective wheel set 12 has an auxiliary wheel 121 and a first pedal 122. The body 1 further includes a chair back 13 rotatably connected on a rear side of the retractable mounting 11 (as shown in FIGS. 1-3 and 6-8) and having two handles 131 symmetrically extending backward from a top of the chair back 13, and the body 1 includes at least one drive device 14 fixed between the chair back 13 and the retractable mounting 11 (as shown in FIGS. 2, 3, 6 and 7). In this embodiment, two first drive devices 14 are symmetrically fixed between the chair back 13 and the retractable mounting 11 so that the chair back 13 is driven by the two drive devices 14 to rotate to a desired angle. The body 1 further includes two frames 15 symmetrically mounted on two sides of the retractable mounting 11 and two armrests 16 arranged on the two frames 15 (as shown in FIGS. 1-8), wherein the two frames 15 have two main wheels 151 rotatably connected on outer sides of the two frames 15 adjacent to rear ends of the body 1, and the two frames 15 have two guide wheels 152 rotatably connected on front ends of the frames 15. The two armrests 16 are arranged on a second drive device 17 (as illustrated in FIGS. 1-8) so as to be driven by the second drive device 17 to lift or descend adjustably, and a respective armrest 16 has an abutting portion 161 disposed thereon. The retractable mounting 11 have two racks 18 symmetrically fixed on two side of a front end thereof (as shown in FIGS. 1 and 4-8), and the two racks 18 have two symmetrical second pedals 181 and two symmetrical contact sheets 182 behind the two symmetrical second pedals 181.

The support plate 20 is detachably engaged on the retractable mounting 11 of the body 10 (as illustrated in FIG. 1) and is a plane or includes a hollow portion 21 formed on a middle of the support plate 20.

The lifting seat 30 is removably engaged on the retractable mounting 11 of the body 1 (as shown in FIGS. 4 and 5), and the lifting seat 30 includes a saddle 31 on a third drive device 32 which is configured to drive the saddle 31 to lift or descend adjustably, and a holder 33 connected on a bottom of the third drive device 32, wherein the holder 33 has two retractable posts 331 extending leftward and rightward, and the holder 33 has two rollers 332 extending frontward and backward, wherein the two retractable posts 331 are coupled on the retractable mounting 11 of the body 10, and the two rollers 332 are configured to abut against a ground.

The shampoo basin 40 is detachably connected on a top of the chair back 13 of the body 10 (as shown in FIGS. 1, 4 and 5), and the shampoo basin 40 includes a washing chamber 41.

The first drive device 14, the second drive device 17, and the third drive device 32 are any one of a pneumatic bar, a gear rack, and a sprocket.

Figure 9:
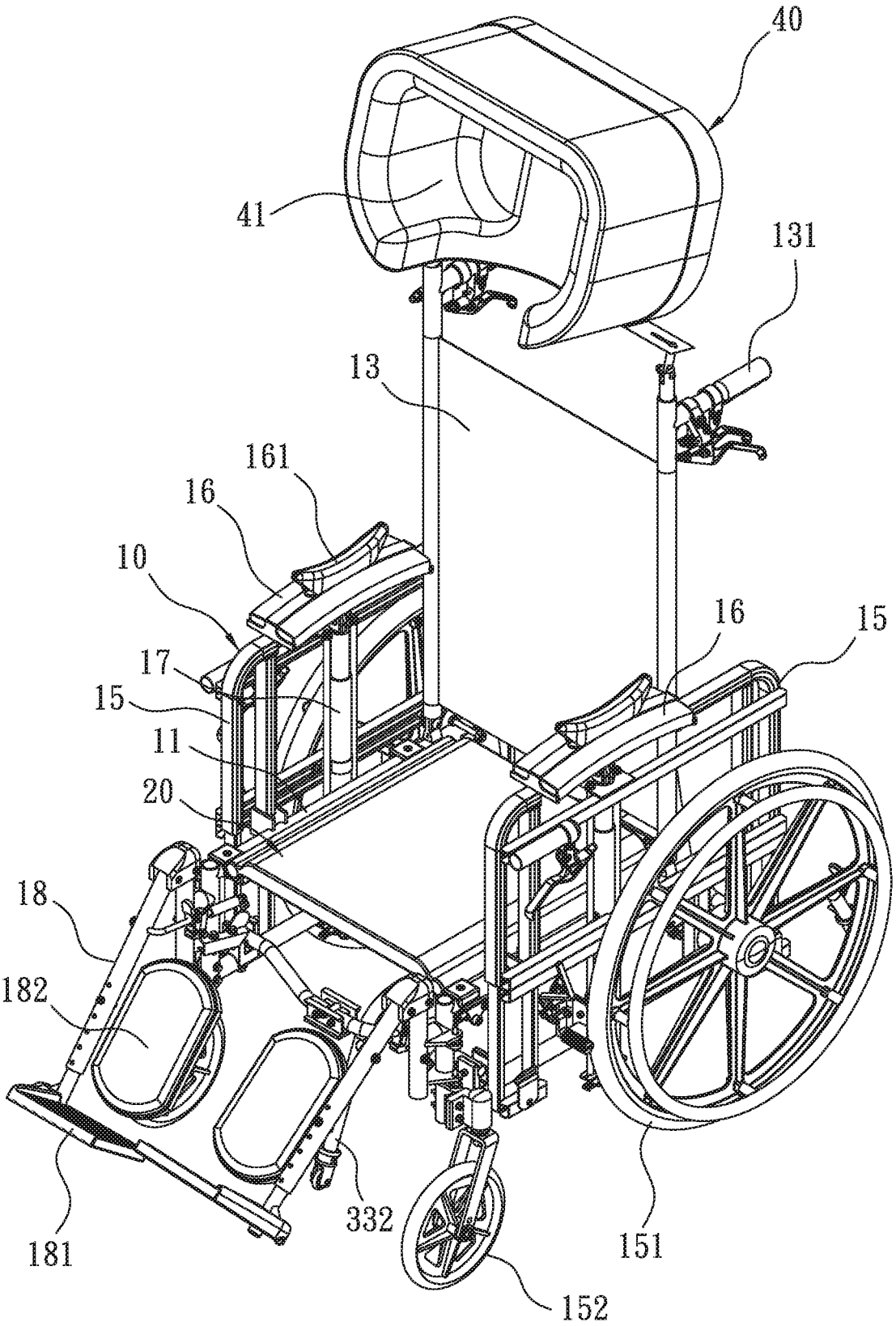
FIG. 9 is a perspective showing the application of the multifunctional wheelchair according to the preferred embodiment of the present invention.

In use, as shown in FIG. 9, the support plate 20 is the plane and is connected on the retractable mounting 11 of the body 10 so as to form in a wheelchair type, wherein the support 20 is configured to be sitting by disabilities.

Figure 10:
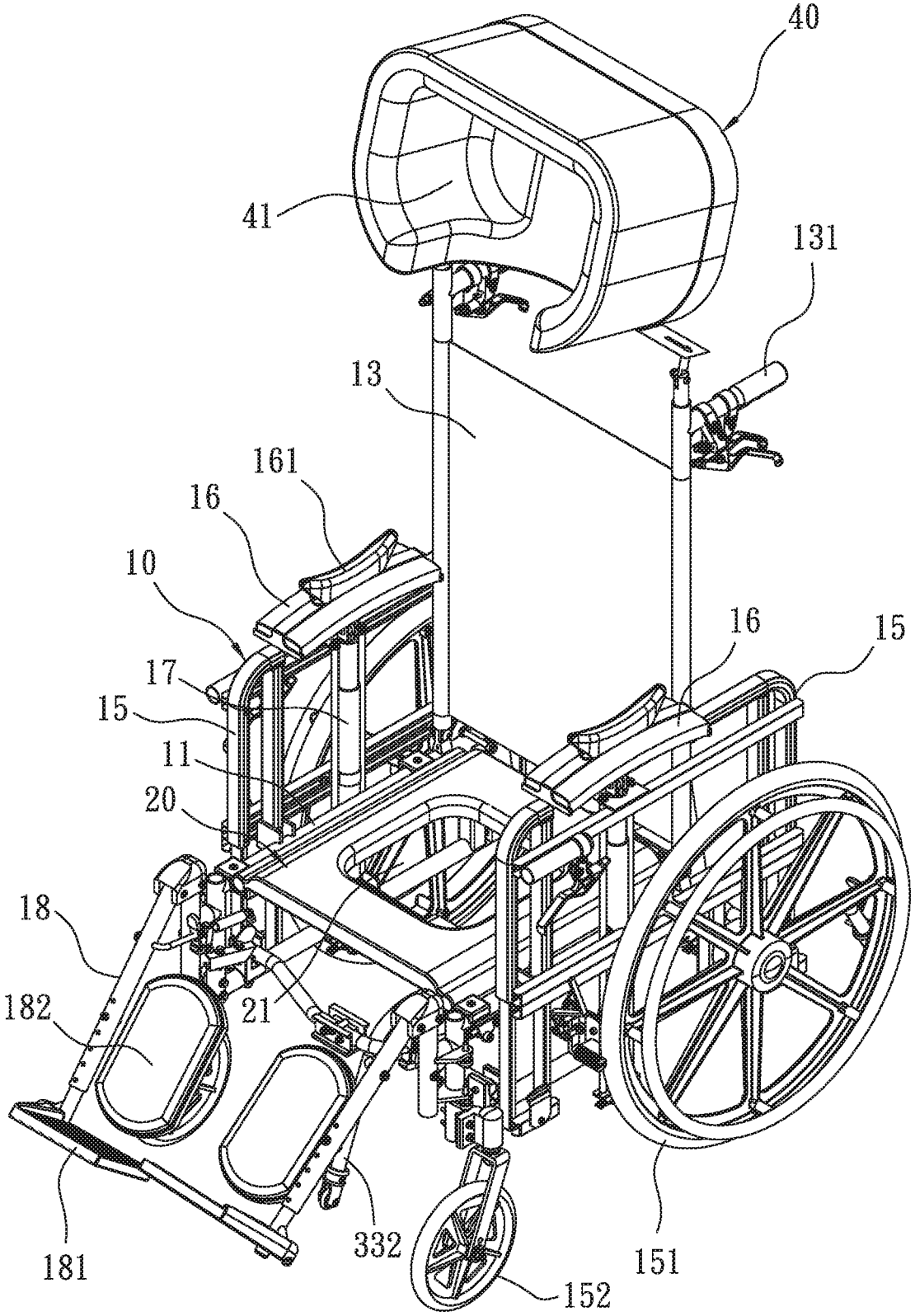
FIG. 10 is another perspective showing the application of the multifunctional wheelchair according to the preferred embodiment of the present invention.

Referring to FIG. 10, the support plate 20 is fixed on the retractable mounting 11 of the body 10 and has the hollow portion 21 formed on the middle thereof, wherein the hollow portion 21 mates with a receiving box (not shown) so that the disabilities sit on the support plate 20 to defecate or pee.

Figure 11:
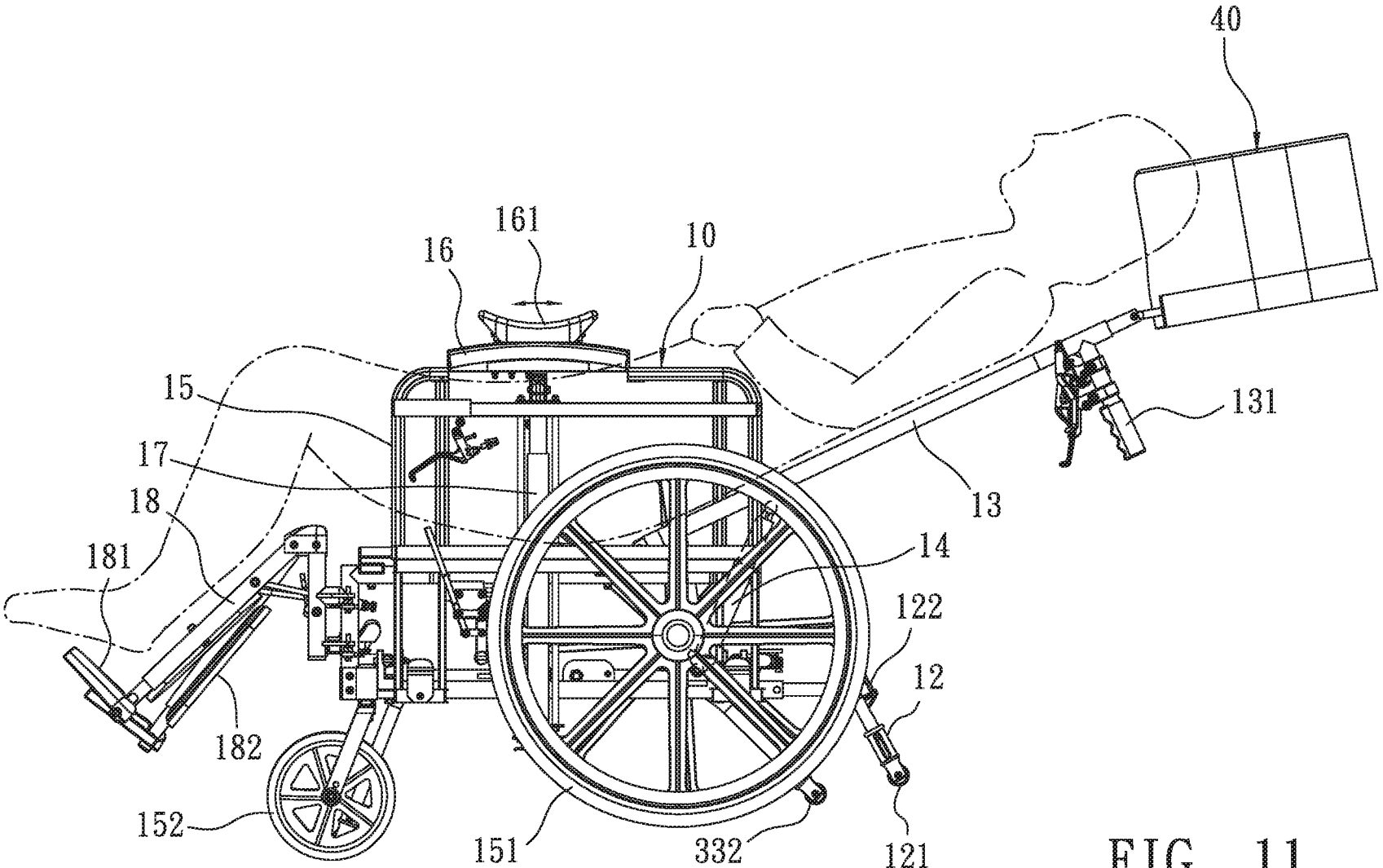
FIG. 11 is another side plan view showing the operation of the multifunctional wheelchair according to the preferred embodiment of the present invention.

With reference to FIG. 11, the first drive device 14 actuates the chair back 13 to adjustably rotate to the desired angle so that the disabilities recline on the wheelchair and a user washes the disabilities' heads in the washing chamber 41 of the shampoo basin 40.

Figure 12:
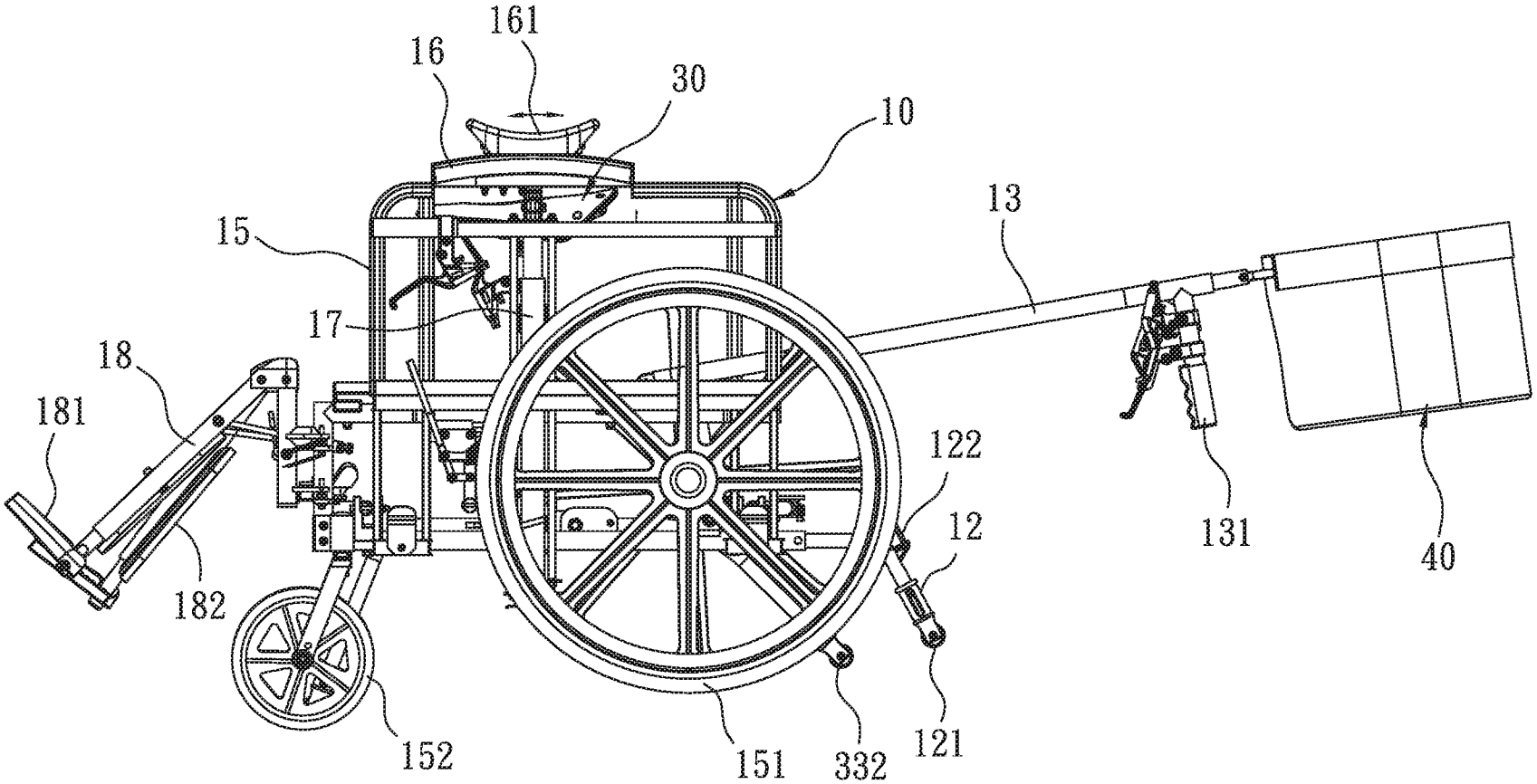
FIG. 12 is still another side plan view showing the operation of the multifunctional wheelchair according to the preferred embodiment of the present invention.

As shown in FIG. 12, the shampoo basin 40 is reversely disposed on the top of the chair back 13 of the body 10, and the chair back 13 is adjusted to the desired angle, wherein the shampoo basin 40 is configured to be used as a pillow, thus obtaining comfort.

Figure 13:
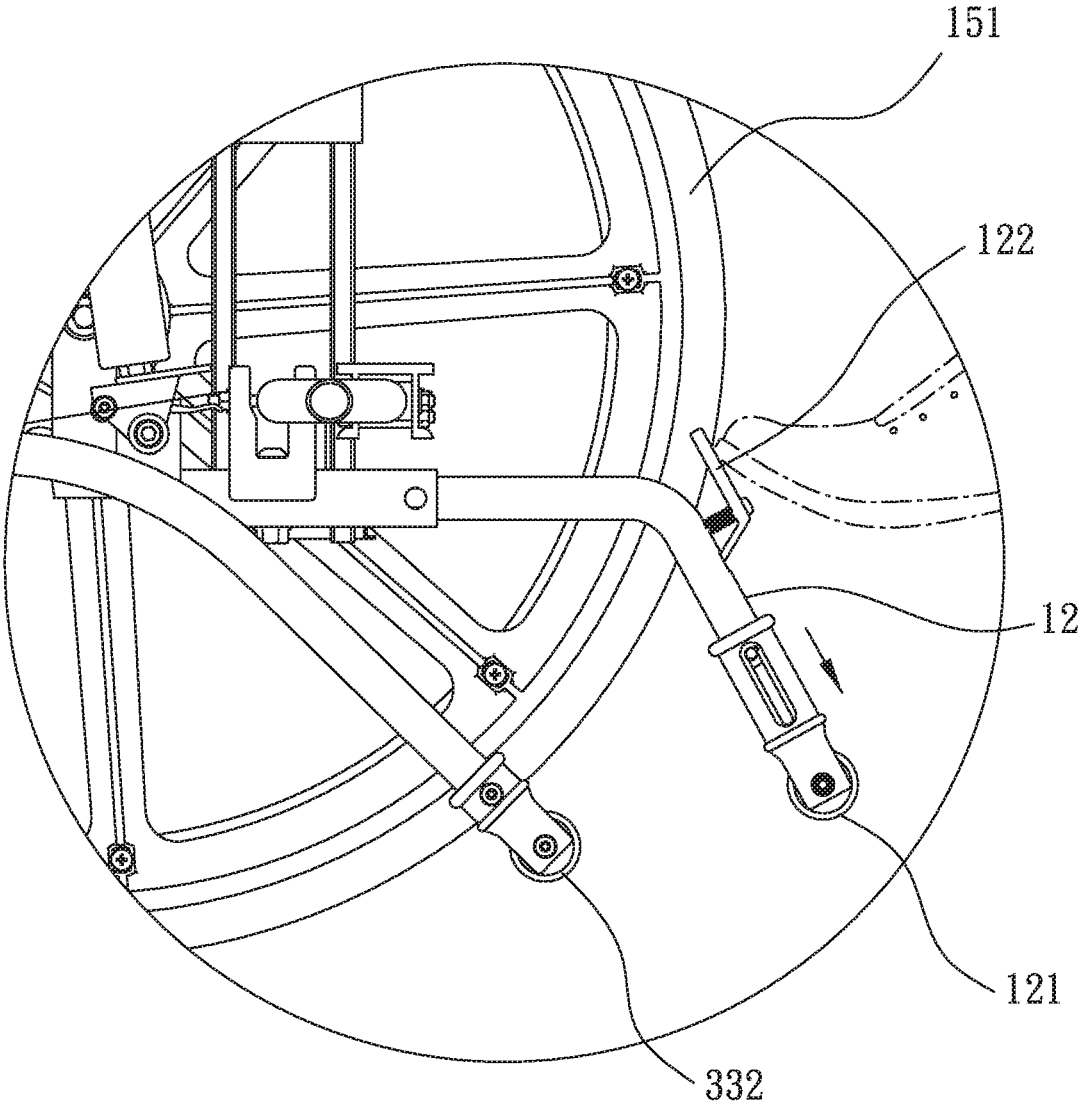
FIG. 13 is a side plan view showing the operation of a part of the multifunctional wheelchair according to the preferred embodiment of the present invention.
Figure 14:
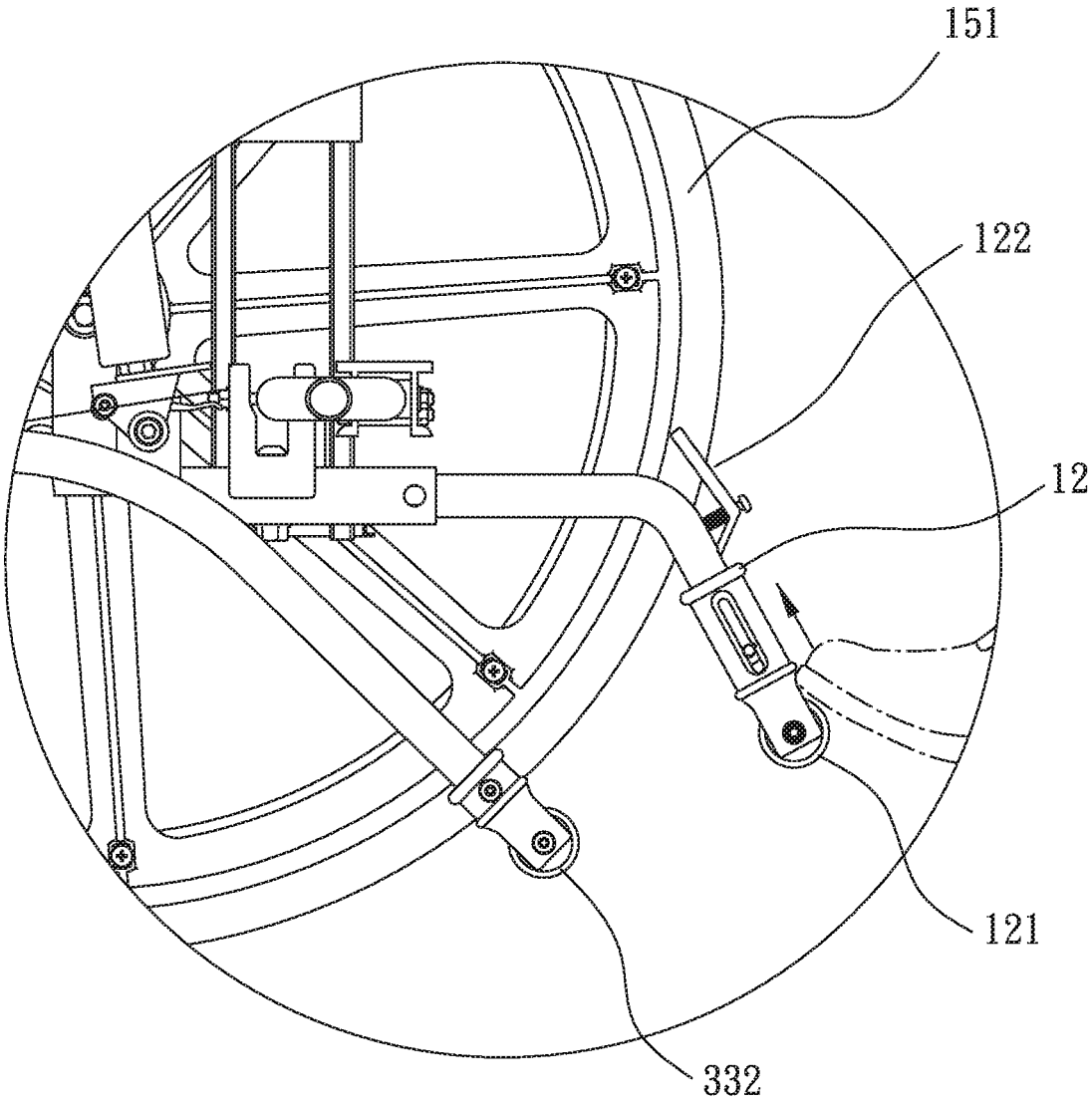
FIG. 14 is another side plan view showing the operation of a part of the multifunctional wheelchair according to the preferred embodiment of the present invention.

When the chair back 13 is adjusted to the desired angle so that the disabilities recline, as illustrated in FIG. 13, the disabilities step on the first pedal 122 of the respective wheel set 12 so that the auxiliary wheel 121 of the respective wheel set 12 abuts against the ground, thus supporting the multifunctional wheelchair auxiliarily. When the chair back 13 is adjusted vertically as shown in FIG. 14, the auxiliary wheel 121 of the respective wheel set 12 is pushed upward so as to be removed from the ground, thus suspending the auxiliary wheel 121.

Figure 15:
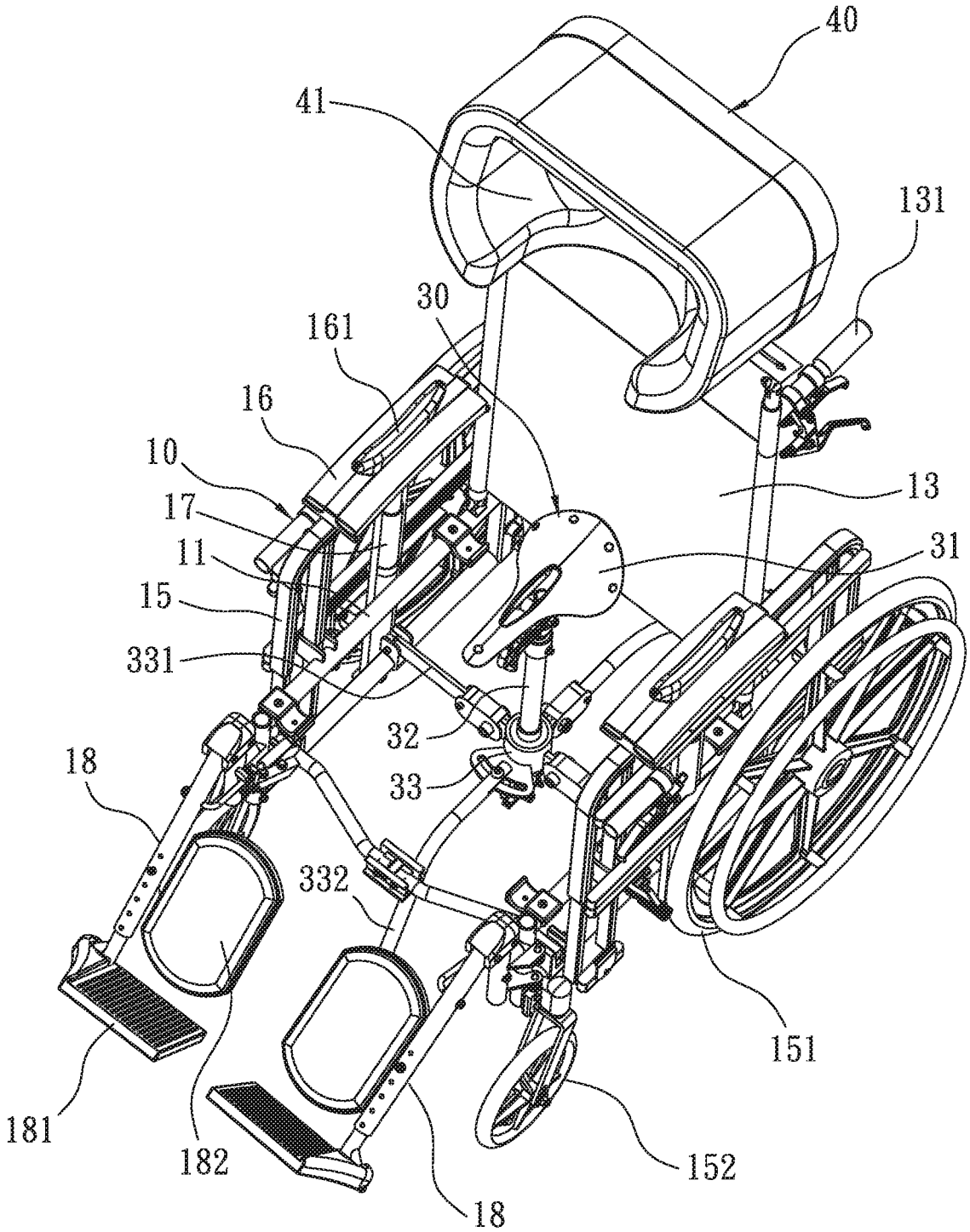
FIG. 15 is still another perspective showing the application of the multifunctional wheelchair according to the preferred embodiment of the present invention.
Figure 16:
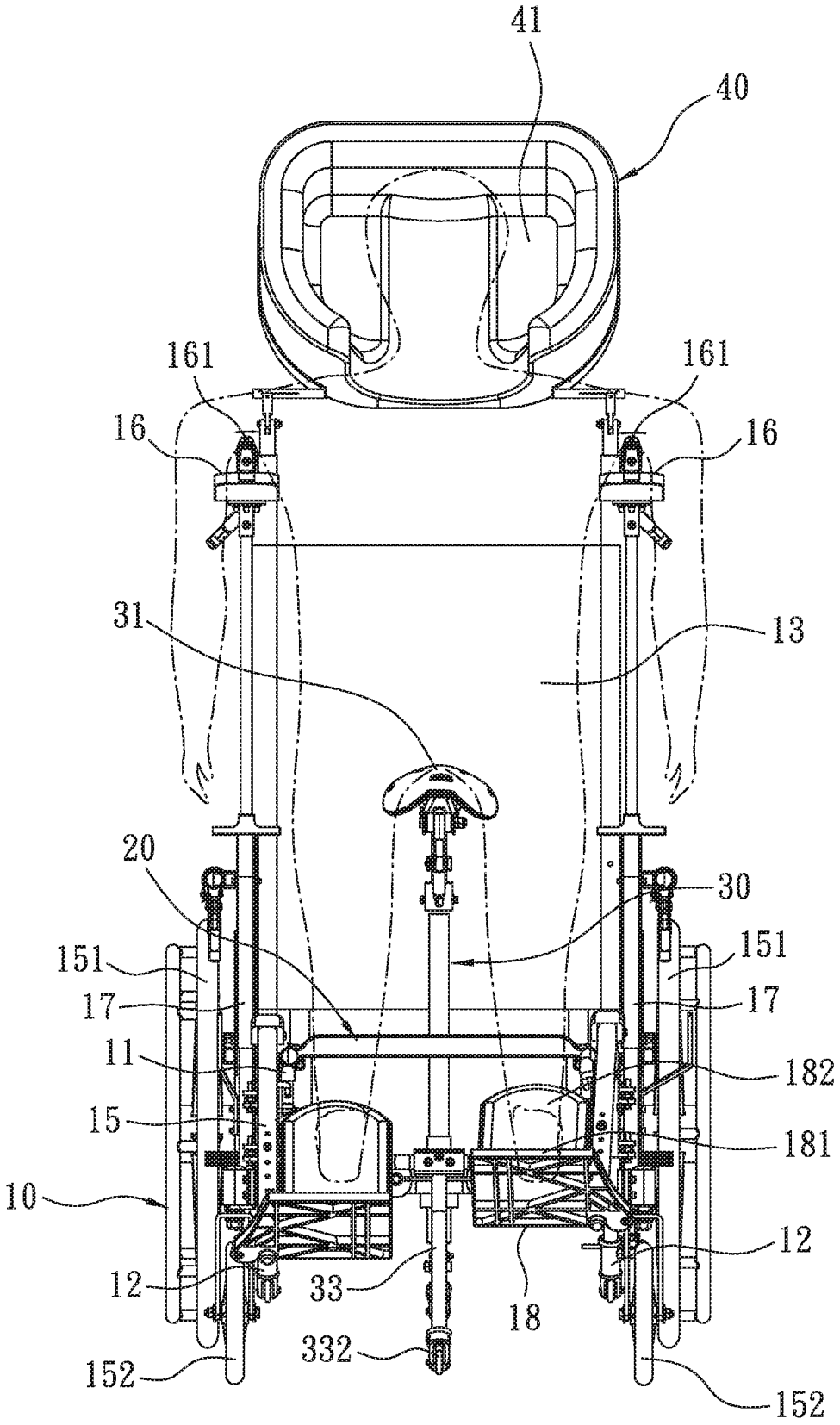
FIG. 16 is also another side plan view showing the operation of the multifunctional wheelchair according to the preferred embodiment of the present invention.

Referring further to FIGS. 15 and 16, when desiring to wash the disabilities' heads, the two armrests 16 of the body 10 are driven by the second drive device 17 to adjustably lift to a desired height, and the saddle 31 of the lifting seat 30 is driven by the third drive device 32 to adjustably lift to the desired angle, wherein the abutting portion 161 of the respective armrest 16 supports the disabilities' armpits, the disabilities are movable to any position, and the saddle 31 of the lifting seat 30 supports and pushes the disabilities' buttocks upward, thus washing the disabilities easily.

Accordingly, the multifunctional wheelchair of the present invention has advantages as follows:

1. The multifunctional wheelchair is adjustable based on using requirements, such as disabilities' lying, piss, defecation, shampoo, or bath, thus obtaining using safety, convenience, and practicality.

2. The multifunctional wheelchair is applicable for sitting, laying, piss, defecation, shampoo, and bath based on the requirements, thus reducing using space and using cost.

While various embodiments in accordance with the present invention have been shown and described, it is clear to those skilled in the art that further embodiments may be made without departing from the scope of the present invention.

What is claimed is:

1. A multifunctional wheelchair comprising:

a body including a retractable mounting, a chair back rotatably connected on a rear side of the retractable mounting, at least one drive device fixed between the chair back and the retractable mounting so that the chair back is driven by the first drive device to adjustably rotate to a desired angle, two frames symmetrically mounted on two sides of the retractable mounting and two armrests arranged on the two frames, wherein the two frames have two main wheels rotatably connected on outer sides of the two frames adjacent to rear ends of the body, and the two frames have two guide wheels rotatably connected on front ends of the frames, the two armrests are arranged on a second drive device so as to be driven by the second drive device to lift or descend adjustably, and a respective armrest has an abutting portion disposed thereon, wherein the retractable mounting have two racks symmetrically fixed on two sides of a front end thereof, and the two racks have two symmetrical second pedals;

a support plate detachably engaged on the retractable mounting of the body;

a lifting seat removably engaged on the retractable mounting of the body, wherein the lifting seat includes a saddle on a third drive device which is configured to drive the saddle to lift or descend adjustably; and a shampoo basin detachably connected on a top of the chair back of the body, and the shampoo basin including a washing chamber, wherein the lifting seat further includes a holder connected on a bottom of the third drive device, and the holder has two retractable posts extending leftward and rightward and has two rollers extending frontward and backward, wherein the two retractable posts are coupled on the retractable mounting of the body, and the two rollers are configured to abut against a ground.

2. The multifunctional wheelchair as claimed in claim 1, wherein the body further includes two wheel sets symmetrically extending downward from a rear side of the retractable mounting, and a respective wheel set has an auxiliary wheel and a first pedal.

3. The multifunctional wheelchair as claimed in claim 1, wherein the chair back has two handles symmetrically extending backward from a top thereof.

4. The multifunctional wheelchair as claimed in claim 1, wherein the retractable mounting have two racks symmetrically fixed on two side of a front end thereof, and the two racks have two symmetrical contact sheets behind the two symmetrical second pedals.

5. The multifunctional wheelchair as claimed in claim 1, wherein the support plate includes a hollow portion formed on a middle thereof.

6. The multifunctional wheelchair as claimed in claim 1, wherein the first drive device, the second drive device, and the third drive device are a pneumatic bar.

* * * * *